US007219727B2

(12) United States Patent
Slack et al.

(10) Patent No.: US 7,219,727 B2
(45) Date of Patent: May 22, 2007

(54) WEAR RESISTANT TUBULAR CONNECTION

(75) Inventors: Maurice William Slack, Edmonton (CA); Robert M. Tessari, Calgary (CA); Per G. Angman, Calgary (CA); Tommy M. Warren, Coweta (CA)

(73) Assignee: Tesco Corporation, Calgary (CA)

( * ) Notice: Subject to any disclaimer, the term of this patent is extended or adjusted under 35 U.S.C. 154(b) by 0 days.

(21) Appl. No.: 10/483,501

(22) PCT Filed: Jul. 18, 2002

(86) PCT No.: PCT/CA02/01114

§ 371 (c)(1),
(2), (4) Date: Aug. 27, 2004

(87) PCT Pub. No.: WO03/008755

PCT Pub. Date: Jan. 30, 2003

(65) Prior Publication Data

US 2005/0011643 A1 Jan. 20, 2005

(30) Foreign Application Priority Data

Jul. 18, 2001 (CA) ..... 2353249

(51) Int. Cl.
*E21B 17/08* (2006.01)
*E21B 17/10* (2006.01)

(52) U.S. Cl. ..... 166/242.6; 175/74; 175/320

(58) Field of Classification Search ..... 166/242.1, 166/242.6; 175/320, 74
See application file for complete search history.

(56) References Cited

U.S. PATENT DOCUMENTS

| | | | | |
|---|---|---|---|---|
| 2,262,211 | A | 11/1941 | Stone | |
| 2,320,107 | A | 5/1943 | Speckert | |
| 2,992,019 | A * | 7/1961 | MacArthur | 285/110 |
| 3,067,593 | A | 12/1962 | McCool | |
| 3,993,368 | A * | 11/1976 | Jurgens et al. | 175/325.4 |
| 4,256,518 | A * | 3/1981 | Bolton et al. | 148/521 |
| 4,665,996 | A | 5/1987 | Foroulis et al. | |
| 4,799,544 | A * | 1/1989 | Curlett | 166/65.1 |
| 4,915,426 | A * | 4/1990 | Skipper | 285/288.1 |
| 5,343,967 | A | 9/1994 | Kruger et al. | |
| 5,749,605 | A * | 5/1998 | Hampton et al. | 285/48 |
| 5,826,921 | A * | 10/1998 | Woolley | 285/334 |
| 5,857,531 | A | 1/1999 | Estep et al. | |
| 6,062,326 | A | 5/2000 | Strong et al. | |
| 6,158,531 | A | 12/2000 | Vail, III | |
| 6,375,895 | B1 | 4/2002 | Daemen | |
| 6,516,880 | B1 * | 2/2003 | Otten et al. | 166/250.11 |
| 6,679,335 | B2 | 1/2004 | Slack et al. | |

FOREIGN PATENT DOCUMENTS

| | | |
|---|---|---|
| CA | 2328190 | 12/2000 |
| EP | 0 783 074 A2 | 7/1996 |
| EP | 0 816 628 A1 | 1/1998 |
| WO | WO 99/25949 | 5/1999 |
| WO | WO 02/10630 | 2/2002 |
| WO | WO 02/103154 | 12/2002 |
| WO | WO 02/103156 | 12/2002 |
| WO | WO 2004/027207 | 4/2004 |

* cited by examiner

*Primary Examiner*—Hoang Dang
(74) *Attorney, Agent, or Firm*—Bennett Jones LLP

(57) ABSTRACT

A wear resistant casing connection including a wear resistant portion on its exterior surface is taught. A casing connection having a controlled bend angle is also taught.

37 Claims, 3 Drawing Sheets

WEAR RESISTANT TUBULAR CONNECTION

FIELD OF THE INVENTION

The present invention relates to tubular connections provided with features that enhance their performance in applications where drilling is conducted with joints of casing joined by such tubular connections. In particular, this invention relates to wellbore casing connections having enhanced wear resistance over at least some portion of their exterior surfaces.

BACKGROUND OF THE INVENTION

Lengths of tubulars used to drill and complete bore holes in earth materials, referred to as joints, are typically joined by threaded connections to form a long assembly referred to as a drill string. Numerous threaded connection geometries are employed to provide sealing and load carrying capacities to meet drilling, installation and operating requirements. Of these geometries, connections having an external diameter greater than the pipe body are the most widely used. Thus the majority length of a typical drill string is comprised of alternating long lengths of generally cylindrical pipe separated by relatively short externally upset intervals at the connections.

Within the context of petroleum drilling and well completion, wells are typically constructed by drilling the well bore using one tubular string, largely comprised of drill pipe, then removing the drill pipe string and completing the well by installing a second tubular string, referred to as casing, which is subsequently permanently cemented in place. The tubular strings are formed by connecting joints of pipe with threaded connections. With this historic method of well construction, both the drill pipe and casing joint designs are separately optimized for the different performance requirements of the drilling and completion operations respectively. More specifically, the drill pipe connections must typically accommodate more torque to drill, than is required during completion, and must resist wear that occurs where the connection is in contact with the abrasive borehole wall during extended periods of drilling rotation. The tendency toward wear is strongly dependent on the lateral forces that arise at the points of contact between the drill string and borehole. These contact forces result from the interaction of several variables, but may be generally attributed to: inertia loads required to react the tendency of the rotating drill string to whirl, reaction of lateral load induced by the axial load transferred along the string through intervals of curvature and gravity loads in deviated intervals. Concentration of all or a majority of the wall contact load over the short upset interval containing the connection tends to exacerbate wear at these locations. This wear has the effect of generally reducing the diameter of the connections. For that reason, it is common industry practice to apply bands or zones of abrasion resistant coatings around the circumference of the drill pipe connections, referred to as hardbanding or hardfacing, to build up the diameter of the connection and thus provide a sacrificial layer of slow wearing material. U.S. Pat. Nos. 4,665,996 and 6,375,895 are two examples describing the materials and application methods used to apply such surface preparations to drill pipe tool joints.

Recent advances in drilling technology have enabled wells to be drilled and completed with a single casing string, eliminating the need to 'trip' the drill pipe in and out of the hole to service the bit and make room for the casing upon completion of drilling. This technology employs a wireline retrievable bottom hole drilling assembly capable of deployment on the distal end of casing strings. Development of the technology was initially motivated by potential cost savings arising from reduced drilling time and the expense of providing and maintaining the drill string, plus various technical advantages, such as reduced risk of well caving before installation of the casing. In addition to drilling, this technology finds utility in casing running applications where reaming is required to resize the borehole.

The established performance requirements for casing are only those required to meet the needs of historic well construction methods. The new use of casing to drill, naturally changes the performance requirements of the casing string. Such changes include increased torque capacity required to drill with the casing connections, but did not initially anticipate the need for increased wear resistance particularly in relatively straight wells where lateral forces arising from curvature and gravity are minimal. This expectation was based on the shorter exposure time to conditions of rotating wear likely for casing strings compared to drill pipe. (Drill pipe is used to drill many wells, resulting in extended exposure of drill pipe connections to conditions of rotating wear. In contrast, the application using a casing string to drill, deliberately only intends to expose the connections to rotating wear conditions for the time required to drill the single well interval to be cased by that string.)

However, it has been discovered that drilling with casing strings using industry standard threaded and coupled buttress (BTC) connections, having tapered pipe thread geometries specified by the American Petroleum Institute (API) and equipped with shoulder rings such as, for example, those described in Canadian Patent Application 2,311,156, frequently causes eccentric wear in the region of the connection. This wear may locally reduce the coupling side wall thickness until the coupling radius, in the region of wear, is little more than the pipe body. This amount of wear may occur during even a fraction of the relatively short period required to drill a single well interval in a nearly vertical well. As will be appreciated by one skilled in the art, this wear substantially compromises the load and sealing capacity of the connection.

This eccentric wear mechanism arises because the straightness of these connections are not as tightly controlled as in drill pipe, since the historic use of casing only contemplates the requirements of running, cementing and well access and not drilling. Thus a small bend in the string axis often occurs across the connections. Such bends tend to preferentially force the connections against the borehole wall at the 'outside' of the bends. The lateral wall contact force arising at these points of contact is strongly dependent on whether or not the lateral deflection imposed by the bend angles in the axially loaded casing is sufficient to interfere with the confining bore hole. This lateral interference acts to displace the casing string from its neutral position at the points of contact with the borehole, the casing string behaving as a long beam bent at the connections and restrained by the borehole. Particularly, where such lateral interference occurs between connections spaced one joint apart, the lateral load and hence wear rate is much greater than occurs over comparably 'straight' intervals.

For example, the connection bend angles were inferred a sample of typical 7 inch (178 mm) API buttress threaded and coupled (BTC) casing joints. These magnitudes were used to calculate the possible maximum lateral load arising from this load mechanism, were such casing joints assembled into a casing string and placed in a borehole drilled with a bit size of 8.5 inches (216 mm). It was found that, with negligible axial load, a lateral force of at least 1000 lbf (4450N) could be present if the casing string were so confined in an interval.

As described above, this lateral load mechanism is not normally present in drill pipe strings placed in a bore hole because the connections in those strings are typically straighter and the tube bodies flexurally less rigid than the same respective components of a casing string assembly. Furthermore, unlike the other lateral loading mechanisms which result in relatively axi-symmetric wear of the connection, wear resulting from the connection bend angle is non-axi-symmetric or eccentric.

This eccentric wear could be mitigated by providing connections with increased straightness. In certain applications this alternative may be preferable. However in general this will increase manufacturing cost and prevent the use of readily available tubulars. Furthermore, the presence of this new lateral wall contact load, while discovered to produce an unfavorable tendency toward excess wear, was simultaneously discovered to have a beneficial effect by improving borehole wall stability and reducing the risk of lost circulation when compared to drilling with straight drill pipe strings.

Excess wear can be avoided by use of a separate device, termed a wear band, as disclosed in Cdn. Patent App 2,353,249. The disclosed wear band includes a band of wear resistant material and is structurally attached to the casing adjacent the connection by crimping. This solution is effective and provides a readily implemented means enhance the usefulness of casing joints having standard non-wear resistant connections for casing drilling or reaming. However, the method requires additional handling and operations to crimp the wear bands to the casing joints with associated labour, capital and logistical overburden costs, plus introducing a longer upset interval length in the region of the connection, which longer interval must be accommodated by the pipe handling, running and drilling equipment.

SUMMARY OF THE INVENTION

A wear resistant connection has been invented for joining lengths of casing tubulars into assemblies referred to as strings. The wear resistant connection of the present invention provides a means to substantially prevent loss of material from the exterior surface of the tube wall, in the region of the connection, caused by rotating wear mechanisms present where such strings are placed in boreholes and rotated. In one embodiment, this wear resistant connection provides resistance to eccentric rotating wear mechanisms arising from the bend angle either accidentally or deliberately present in casing connections.

For the purpose of this invention, a connection is understood broadly to mean any arrangement or device that joins the ends of casing tubulars to create a section over which a structural union is arranged so that the axes of the joined tubulars is substantially continuous across the connection interval, and while generally straight, may have a small bend either accidentally or deliberately introduced. Understood thus, the connection of the present invention includes but is not limited to welded connections, integral connections and threaded and coupled connections. Where an upset interval is associated with such a connection, references to the connection are understood to include this upset interval. Where the connection is made without an upset interval, i.e., an externally flush connection, reference to the connection is understood to include a section of the joined casing tubulars having a length of at least 10 casing diameters on each side of the actual joint (i.e. the weld) between the casing tubulars.

Thus in accordance with a broad aspect of the present invention, a casing connection is provided having an exterior surface, at least some portion of which includes a wear resistant material.

The casing connection is preferably selected to be useful for drilling with casing.

The wear resistant material can be arranged to at least overlap the circumferentially oriented location forming the outside of any bend that may be accidentally or intentionally imposed across the connection.

The wear resistant material may be integral to the connection, obtained by surface hardness treatment such as boronizing, nitriding or case hardening or applied thereto such as by use of a coating such as hardfacing. The relatively high cost of the applying, working with and forming wear resistant materials encourages a reduction in the size of the area covered and thickness of material.

The vast majority of well bores are lined with metal casing strings having threaded connections. Therefore to be most readily implemented, wear resistance of metal casing connections is best provided in a manner which accommodates existing thread-forms, sealing geometries and bend magnitude tolerances. Such existing threaded connections include the thread-forms and sealing geometries comprising so called premium connections, in addition to both integral and threaded and coupled American Petroleum Institute (API) specified geometries. (Reference herein to a 'thread-form' is generally understood to include the seal geometry if present, unless these two components of the connection geometry are specifically separated in the context.) This accommodation of existing geometry extends to the connection diameter where it is preferable to provide wear resistance without a significant increase in outside diameter to avoid correlatively increasing the annular flow resistance, where such a wear resistant connection is deployed in a casing string within a well bore.

It is advantageous to adapt existing threaded connection geometries to provide locations where wear resistant materials can be most economically and least invasively applied to the connection, i.e., without significantly altering the existing connections with respect to seal and structural performance, while providing adequate protection against wear from rotation while drilling. In particular, preferably the wear resistant material is provided at the lower or leading end of the coupling (leading is defined with respect to the axial direction of travel while drilling), as the upset diameter change from the pipe body to the coupling occurring at this location tends to promote preferential wear while drilling with casing.

Threaded and coupled connections according to the present invention can include an internally threaded coupling having an upper end, a lower end and generally cylindrical exterior surface, as typically provided for such couplings, where wear resistant surface treatment or coating material is disposed axi-symmetrically on said external surface over one or more axial intervals to form one or more hardbands of diameter somewhat greater than the diameter of the generally cylindrical exterior surface. Said axial interval length and coating thickness are chosen, based on application requirements, to provide sufficient volume of material to resist wearing through to the base metal. Wear resistant surface treatment or coating material is axi-symmetrically distributed to accommodate the random distribution of bend angle and hence circumferential location of connection contact with the well bore.

For most of these geometries, wear resistance can be provided by applying coatings resistant to abrasive wear to the exterior surface of the connection. Such coatings are commonly referred to as hardfacing. These coatings are applied using a variety of techniques and materials, but typically the bond chemistry and mechanics require heat input to obtain the elevated temperature required to create a strong bond between the coating and metal substrate. It is therefore necessary to consider the effects of this heat input and bond chemistry on the metal substrate, and in particular to allow for any changes in structural or mechanical performance the heat input and bond chemistry might have.

In addition, the choice of axial interval location where wear resistant surface treatment or coating is provided is preferably selected to occur at locations where stresses induced by structural and pressure loads are lowest. Such choice of location reduces the risk of connection failure due to crack initiation within the typically brittle coating material.

However such a suitable region of low stress is often not available for many of the threaded and coupled connection geometries employed by industry. It is therefore a further purpose of the present invention to provide such a suitable region of low stress at one or both ends of the coupling by more preferably providing a coupling having its length and interval of internal threading arranged so that the end hardband interval does not overlap with the internal threaded interval of the coupling. Otherwise stated, relative to the 'standard' non-wear resistant coupling geometry a coupling is provided where at least one end and preferably the lower end is modified to provide a generally cylindrical extension which extension or extensions having external and internal surfaces without load bearing threads on which said external surface or surfaces wear resistant surface treatment or coating material such as hardfacing is applied to create a hardband or hardbands of upset diameter. Where only one hardband is required, the lower end is preferred as this end forms the leading edge of the coupling while drilling with casing and protects this region from preferential wear.

Application of these teachings for placement of wear resistant surface treatment or coating material on the couplings of threaded and coupled connections may be extended to integral connections and externally upset integral connections. As commonly understood in the industry, an integral connection is comprised of an externally threaded pin formed on the end of one tubular screwed into a mating internally threaded box formed on the end of a second tubular. Said internally threaded box having an external largely cylindrical surface and proximal end. Particularly where the connection design is arranged to shoulder on said proximal end when made up to the pin, the stress state in this region is less prone to crack initiation and propagation. To best serve the purposes of the present invention a wear resistant integral connection is therefore provided having a hardband of wear resistant surface treatment or coating material disposed on its proximal end. Relative to the 'standard' non-wear resistant geometry of an integral connection box it is more preferable if the proximal end of the box is modified to provide a generally cylindrical extension which extension having external and internal surfaces without load bearing threads on which said external surface wear resistant surface treatment or coating material such as hardfacing is applied axi-symmetrically to create a hardband or hardbands of upset diameter.

Where the integral connection is formed on externally upset tubulars, such externally upset interval typically extends beyond the depth required to carry the box or pin threaded connection geometry, and in certain applications it may be preferable to provide a hardband on the connection exterior surface at or near the leading end of the upset interval either separately or in combination with a hardband placed at the proximal end of the box. The leading end of the upset interval, thus carrying the hardband, occurs at a location of significantly greater thickness than the pipe body and therefore of significantly reduced stress, but having the further advantage of being positioned at the location of preferential wear. It is therefore an additional purpose of the present invention to provide a wear resistance externally upset tubular connection having an externally upset interval with leading and trailing ends comprising the connection, and having at least one hardband positioned on said leading end.

The bend magnitude occurring across the connection interval is a function of the pipe end straightness and combined thread axis angle alignment with the pipe axes for integral connections and additionally the coupling thread axes with respect to the coupling for threaded and coupled connections. For industry typical casing connections, the bend magnitude or axis misalignment is not tightly controlled, as for example described in the API Specification 5CT and Standard 5B. Furthermore the bend direction is randomly oriented.

The wear resistant casing connections of the present invention enjoy further utility when also deliberately provided with a small bend in tubular axis across the connection interval. Where such connections are employed to assemble a plurality of tubular joints to form at least one interval of a casing string placed in a borehole, the bend angle and direction controls the local lateral stess of the casing string within the confines of the borehole. The bend angle and direction may thus be arranged to deflect some or all of the connections into generally radially opposed contact with the borehole wall over an interval of several joints. As will be apparent to one skilled in the art, the lateral forces arising from this contact will tend to increase with increasing bend angle. It will also be apparent that control of the bend direction provides a further means to control this force compared to random orientation of connection bend direction. When such a string is rotated within the confining borehole, the region of connection contact rotates with respect to the borehole causing an axi-symmetric 'wiping' action on the interior of the borehole wall, but does not rotate with respect to the connection causing the associated wear mechanism to be non-axi-symmetric, i.e., eccentric. In certain applications, the wiping action thus provided results in axi-symmetric consolidation of the near well bore earth material, reducing risk of sloughing and lost circulation. The degree of consolidation and associated benefits depends on the lateral force generated by the casing as it bears against the borehole wall. Control of the connection bend magnitude, and preferably also the bend direction, enables control of said lateral force exerted and is thus a means to balance the benefits gained by wiping action on the borehole wall against the eccentric wear rate of the connection. This then is the basis for the further utility obtained for the present invention of a wear resistant connection having a controlled small bend.

In accordance with this further purpose, in one embodiment of the present invention, a wear resistant casing connection is provided having at least some portion of its exterior surface provided with a wear resistant coating or surface treatment and arranged to provide a controlled bend in the axes of the tubulars joined by the connection. Said bend magnitude is selected such that when said bent wear resistant connections are employed to assemble at least some portion of a plurality of tubular joints to form at least one interval of a casing string placed in a borehole, the resulting local directional variations introduced by the bend magnitudes will induce some or all of the bent wear resistant connections to at least contact the borehole wall and induce generally radially opposed contact forces.

As a means to more predictably control said radially opposed contact forces, in a further embodiment, said wear resistant casing connection of controlled bend is provided having the circumferential direction of the bend controlled with respect to a casing string assembled from such connections. Such control of circumferential direction is preferably selected to provide a repeating pattern between bent connections comprising an interval of an assembled casing string.

As will be apparent to one skilled in the art, the teachings of the present invention with respect to placement of wear resistant surface treatment or coatings on typical threaded connection geometries to form wear resistant connection where the bend angle and direction is allowed to vary randomly according to existing industry practice apply equally well to connections where the bend angle is controlled. However, where the bend angle is introduced deliberately in the manufacturing process the circumferential location corresponding to the outside of the bend may be readily identified. Since contact with the borehole must occur at this location wear resistant surface treatment or coating material need only be disposed over this region and need not be disposed axi-symmetrically, thus requiring less volume of wear resistant material with consequent opportunity for cost saving.

In accordance with another aspect of the present invention, there is provided a casing string including an interval over which the bend angle is selected to control the lateral reaction force of the casing string against the borehole wall in which the casing string is intended to extend.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENT

According to the present invention, a wear resistant casing connection is provided for joining two lengths or joints of tubulars suitable for drilling with casing. In its preferred embodiment, the wear resistant casing connection is generally of a threaded and coupled nature and more preferably employs a thread-form geometry compatible with a buttress connection as specified by the American Petroleum Institute (API).

Figure 1:
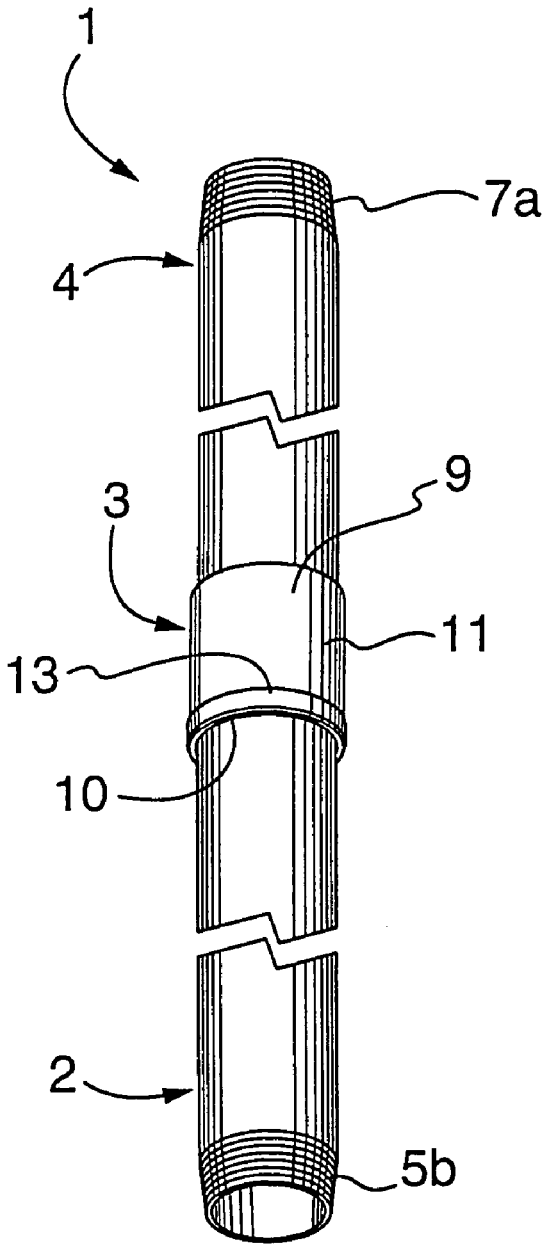
FIG. 1 is a perspective view of a wear resistant connection according to one embodiment of the present invention.
Figure 2:
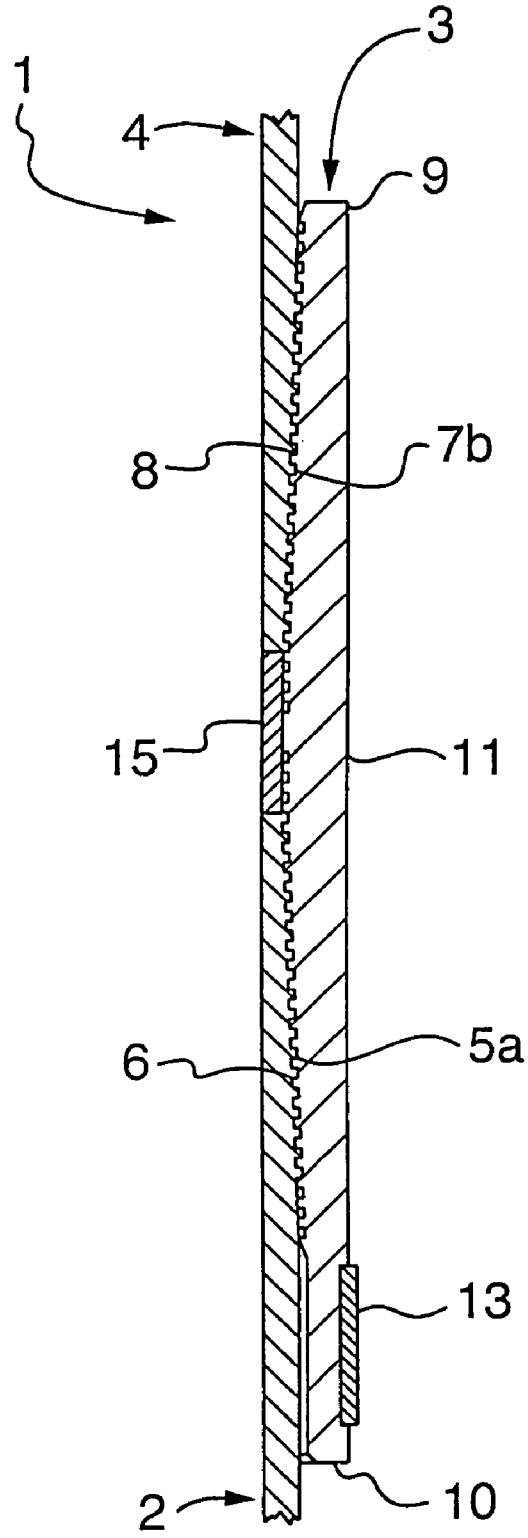
FIG. 2 is a sectional view through the sidewall of the connection shown in FIG. 1 wherein a shoulder ring is included to provide improved torque capacity.

Referring to FIGS. 1 and 2, an assembled threaded and coupled wear resistant connection 1 is shown according to one embodiment of the invention including a lower joint 2 with threaded ends 5*a*, 5*b*, an internally threaded coupling 3 and an upper joint 4 with threaded ends 7*a*, 7*b*. As commonly understood in the industry, the connection is assembled or 'made up' by screwing the externally threaded mill end pin 5*a* of lower joint 2, into the mill end box 6 of coupling 3 and screwing the field end pin 7*b* of upper joint 4 into the field end box 8 of coupling 3 to form a sealing structural union. The generally cylindrical coupling 3 includes an upper end 9, a lower end 10 and a hardband 13 formed from application of hardfacing axi-symmetrically about the circumference of the coupling on the exterior surface 11 adjacent lower end 10. In the illustrated embodiment, the hardfacing is applied in a substantially uniform thickness to form the hardband.

The main body of coupling 3 is arranged to generally match the thread-form geometry, tolerancing and length of an API specified buttress connection, where the lower end 10 is formed as a generally cylindrical extension of the main body. The extension extends out beyond the threads 6*a* of the mill box end a sufficient length to carry the hardband 13 such that the hardband does not radially overlap the threaded interval of the mill end box 6.

The outer diameter of the coupling at hardband 13 is preferably selected to be greater than the diameter of the coupling outer surface 11 to such that the hardband preferentially contacts the borehole wall when connection 1 is employed in a casing string. However, when selecting the outer diameter of the hardband, care should be taken, with consideration as to the borehole diameter in which the coupling is to be used to reduce adverse effects on annular flow.

A multi-lobe shoulder ring 15 is disposed in the coupling centre region, between the mill and field end pins 5*a*, 7*b*. Under application of sufficient torque the mill and field end pins 5*a*, 7*b* are caused to abut ring 15 to thus increase torque capacity in support of drilling with casing as described in Canadian Patent Application 2,311,156.

The illustrated embodiment of FIGS. 1 and 2, thus provides a wear resistant connection where the manufacturing of the pin and box thread-forms is compatible with existing industry practice with respect to geometry, tolerance and make-up practice.

Figure 3:
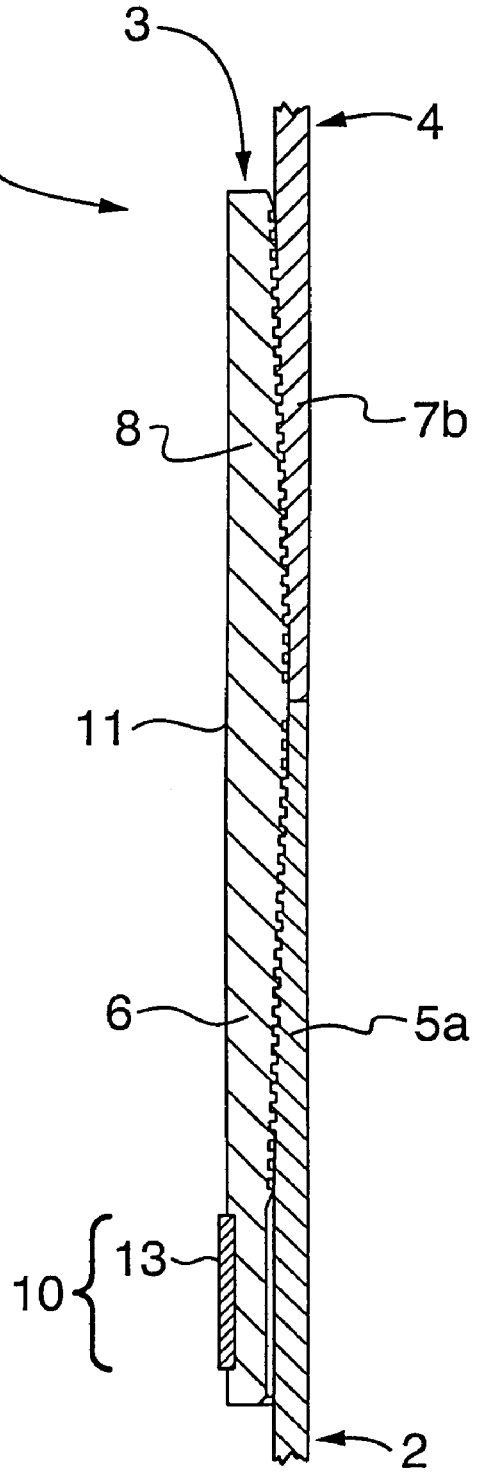
FIG. 3 is a sectional view through the sidewall of another connection wherein improved torque capacity is provided without a shoulder ring.

Referring now to FIG. 3, an alternate embodiment of a wear resistance connection is shown where the geometry of the coupling 3 is arranged to support direct abutment of the field and mill end pins 5*a*, 7*b*, under application of sufficient torque, eliminating the need to use a torque ring. To support this alternate embodiment, the thread form geometry and tolerancing of the coupling is adjusted, relative to the API specified standards, to accommodate pin ends made according the API specified standards for geometry and tolerancing. The coupling is adjusted by reducing the length of the thread-form of the coupling main body to eliminate the pin end standoff and by adjusting the diameter and taper tolerance of boxes 6, 8 to ensure that the smallest API allowable field or mill end pins, when made up to the centre of the coupling main body, will result in sufficient radial interference to create the normally intended thread seal. Thus configured, the connection is preferably made up using position control to ensure the pin ends 5*a*, 7*b* are brought into abutment at generally the center of the coupling. The embodiment of FIG. 3 thus offers compatibility with standard forms of casing joints with threaded pin ends, but is shorter than a coupling according to FIG. 2 and achieves increased torque capacity over a standard non-shouldering API connection without requiring a shoulder ring, thus reducing cost and complexity.

Figure 4:
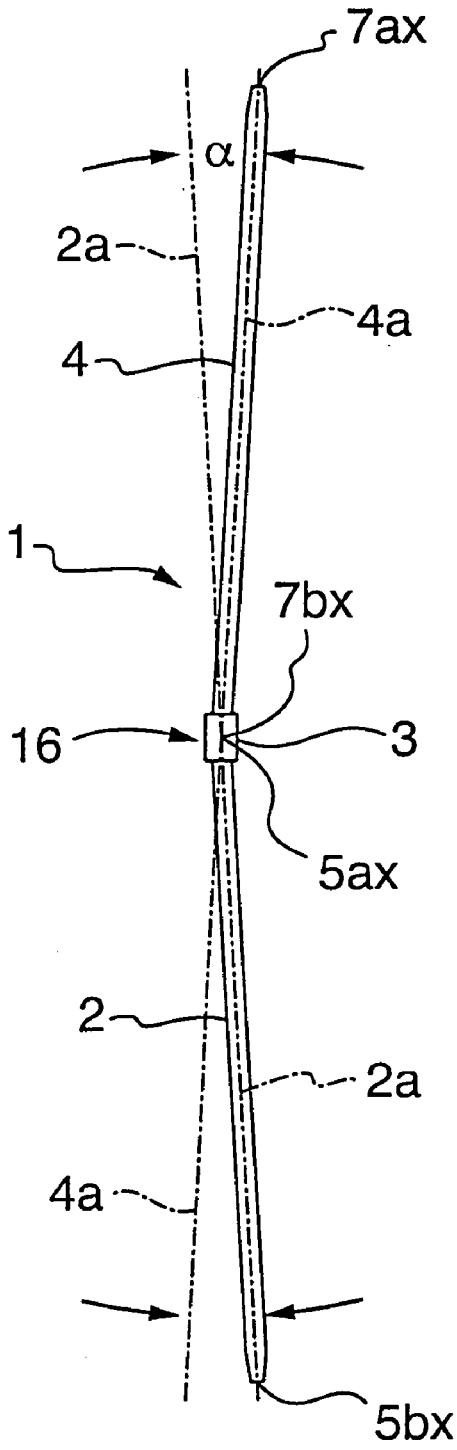
FIG. 4 is a front elevation of a pair of connected casing joints showing the bend angle formed by the connection shown in FIG. 1.

The bend angle and direction formed across the assembled connection 1 depends on the cumulative effect of the thread axis angle misalignments and the relative direction of the misalignments for the pins 5*a*, 7*b* and boxes 6, 8 after make-up. With reference now to FIG. 4, the bend angle α is defined as the angle change between a first line 2*a* extending though the center points 5*ax*, 5*bx* at the ends of the lower joint 2 and a second line extending though the center points 7*ax*, 7*bx* at the ends of the upper joint 4 in the connection. The bend angle or connection straightness is dependant on variables generally controlled by specifications known to the industry such as: pipe straightness, pin geometry parameters such as imperfect thread limits for buttress threads, coupling thread angular misalignment and make-up position. Prevalent industry practice for control of these variables results in randomly controlled casing connection bend magnitudes, where a significant number of connection bend angles are greater than allowed by comparable drill pipe specifications. Therefore, when a plurality of such connections are employed to form a tubular casing string placed in a bore hole, joint to joint local directional variations interfering with the borehole confinement are likely. As noted hereinbefore, this interference is frequently great enough to cause large radial or lateral reaction loads between the connection outside bend surface 16 and the confining borehole wall and, thus, there is a need to protect the connections against excess rates of wear under conditions of extended rotation, such as in drilling with said tubular casing string.

While the wear resistant connections shown in FIGS. 2 and 3 are useful for applications where the bend angle α is allowed to vary randomly in accordance with typical industry practice for manufacture and assembly of threaded and coupled casing connections, in certain applications it is desirable to control the magnitude of said lateral reaction force in at least one interval of an assembled casing string, which lateral reaction force is dependent on several design variables including: casing flexural stiffness, spacing between contacting bent connections, axial load, relative radial orientation of connection bends and radial interference of local bent section as controlled by the magnitude of the connection bend angle α.

To control of lateral load arising in an interval of a casing string, it is useful to control the bend angle geometry and spacing along that string interval. This can be done by surveying couplings and casing joints to determine the bend angle magnitude at a connection of selected ones of the couplings and casing joints and selecting the couplings and casing joints to be used in the string interval.

Figure 5:
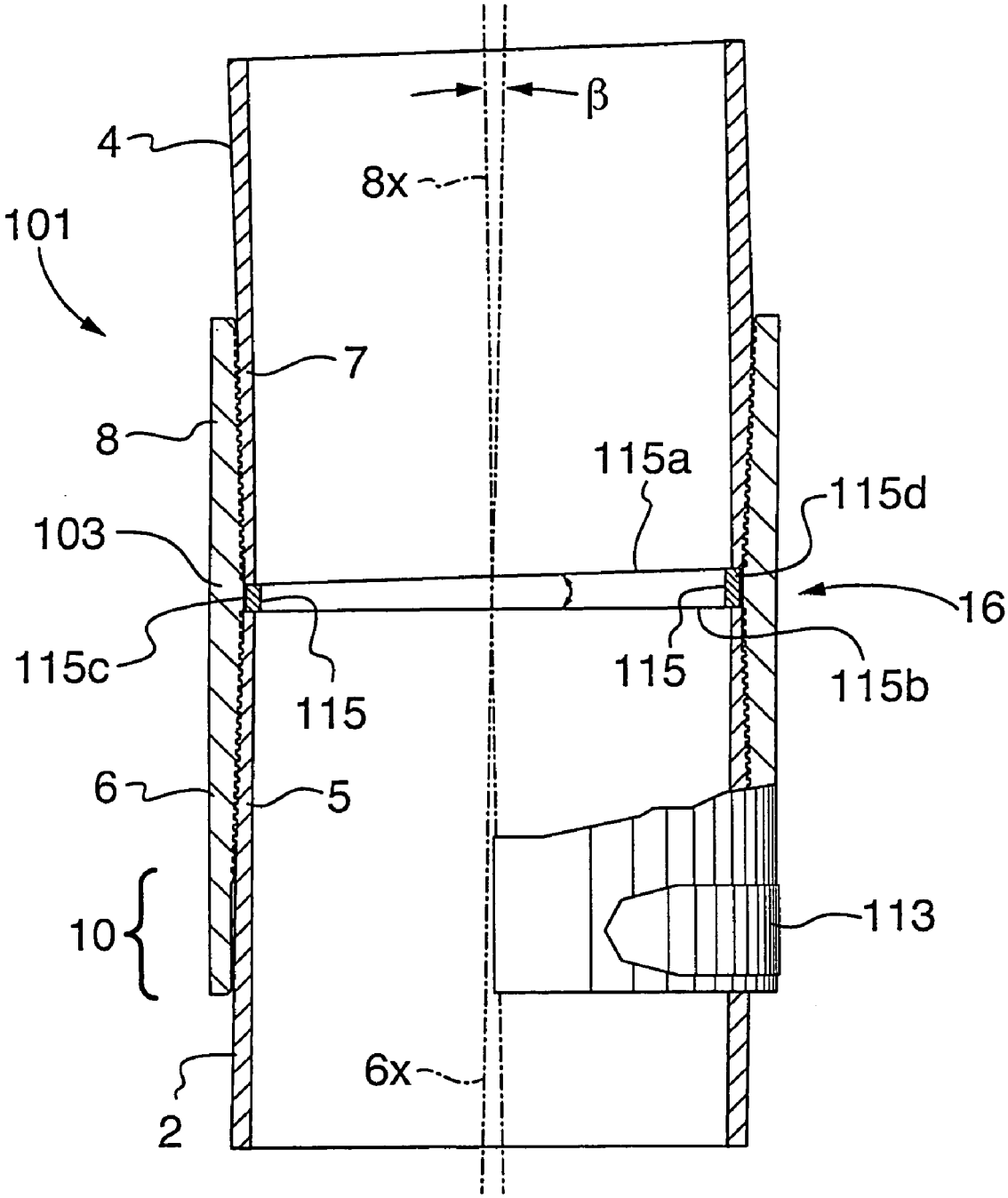
FIG. 5 is a partially cut away view through another connection, where the coupling bend angle is controlled.

Referring now to FIG. 5, in an alternate embodiment of the present invention a bent wear resistant connection 101 largely as shown in FIG. 2 is provided, but where the center axis 6*x* of the mill end box 6 and the center axis 8*x* of the field end box 8 are offset out of alignment to form a bent coupling 103 having an angle β between axes 6*x* and 8*x*. A wear pad 113 is positioned on the outer surface of the coupling about the circumferential location defined by the outside bend 16 of bent coupling 103. Coupling 103 accommodates a shoulder ring 115 which substantially conforms to the bend of the coupling. In particular, shoulder ring 115 includes end faces 115*a*, 115*b* defining planes that are not parallel, such that the width of the ring varies from a narrow wall 115*c* to a long wall 115*d*. The ring is set within the coupling bore having its long wall 115*d* positioned radially inwardly of outside bend 16 of the bent coupling 103. The planes of end faces 115*a*, 115*b* therebetween define an angle selected to be similar to that of angle β.

In use, the bent coupling can be employed to achieve further control of said lateral force arising from confinement within a borehole, by selecting the frequency of bent connections and, thereby the spacing therebetween, and by controlling the relative orientation of outside bend position 16 between sequential bent couplings employed to connect a plurality of tubular joints forming an interval in a casing string. To conveniently select the bend orientation of the connection during make up of a string, means, such as a power tong, can be used to apply torque to the coupling for control of mill end make-up position. Final mill end make-up position may then be selected to align the outside bend position of sequential connections at, for example, positions 180° apart or other similar pattern as required.

In a further embodiment, the casing joint pin ends used can have the misalignment tolerance of their thread axes reduced from typical industry practice to further improve control of their bend angle.

It will be apparent that many other changes may be made to the illustrative embodiments, while falling within the scope of the invention and it is intended that all such changes be covered by the claims appended hereto.

The invention claimed is:

1. A casing coupling comprising: an outer surface, a box end including an end edge and a threaded interval therein, an extension between the end edge and the threaded interval, the extension including a non-load bearing inner surface and an outer-facing surface; and a hardfacing on the outer facing surface.

2. The casing coupling of claim 1 wherein the extension extends beyond any load bearing threads of the threaded interval.

3. The casing coupling of claim 1 wherein the extension is formed to be generally cylindrical.

4. The casing coupling of claim 1 wherein the end edge defines a leading edge of the casing coupling during insertion of the casing coupling into a well.

5. The casing coupling of claim 1 wherein the box end is on a mill end.

6. The casing coupling of claim 1 wherein the hardfacing is applied on the outer-facing surface of the extension without overlapping the threaded interval.

7. A casing coupling comprising: a main body formed as a cylinder and including a first end, a second end, an outer surface and an axial inner bore defined by an inner surface, load bearing threads formed from material of the main body and positioned on the inner surface adjacent the first end, and an extension on only one end of the main body, the extension being positioned between the load bearing threads and the first end and including a wear resistant material on an external surface of the extension, the wear resistant material having a wear resistance greater than the material forming the load bearing threads.

8. The casing coupling of claim 7 wherein the load bearing threads are part of a threaded interval and the extension extends beyond any threads of the threaded interval.

9. The casing coupling of claim 7 wherein the first end is the lower end.

10. The casing coupling of claim 7 wherein the first end is a mill end.

11. The casing coupling of claim 7 wherein the external surface is generally cylindrical.

12. The casing coupling of claim 7 wherein the wear resistant material is in the form of a hardband.

13. The casing coupling of claim 7 wherein the extension extends axi-symmetrically about the first end relative to an axis defined by the axial inner bore.

14. The casing coupling of claim 7 wherein the wear resistant material is positioned on the external surface of the extension substantially without overlapping the load bearing threads.

15. The casing coupling of claim 7 wherein the wear resistant material is applied by hard facing.

16. The casing coupling of claim 7 wherein the wear resistant material is formed by heat treatment.

17. A casing string comprising: at least one casing joint including an externally threaded pin end and a casing coupling including a box end including an end edge and material forming a threaded interval therein, and an extension between the end edge and the threaded interval, the extension including a wear resistant material on an outer surface of the extension, the wear resistant material having a wear resistance greater than the material forming the threaded interval, the casing coupling threadedly engaged by load bearing threads of the threaded interval to the pin end of the at least one casing joint with the extension spaced from contact with the pin end and extending out beyond any threads of the pin end.

18. The casing string of claim 17 wherein the end edge defines a leading edge of the casing coupling during insertion of the casing string into a well.

19. The casing string of claim 17 wherein the box end is on a mill end.

20. The casing string of claim 17 wherein the extension has a non-threaded inner surface.

21. The casing string of claim 17 wherein the wear resistant material is positioned substantially without overlapping the threaded interval.

22. The casing string of claim 17 wherein the wear resistant material is applied by hard facing.

23. The casing string of claim 17 wherein the wear resistant material is formed by heat treatment.

24. A casing connection comprising: a casing joint including a pin end with threads formed thereon and a casing coupling including a box end including an end edge and a threaded interval therein, and an extension between the end edge and the threaded interval, the extension including a wear resistant material on an outer surface of the extension, the wear resistant material having a wear resistance greater than the threaded interval, the casing coupling threadedly engaged by load bearing threads of the threaded interval to the threads of the pin end with the extension spaced from contact with the pin end and extending out beyond the threads of the pin end.

25. The casing connection of claim 24 wherein the end edge defines a leading edge of the casing coupling during insertion of a casing string including the connection into a well.

26. The casing connection of claim 24 wherein the box end is on a mill end.

27. The casing connection of claim 24 wherein the extension has a non-threaded inner surface.

28. The casing connection of claim 24 wherein the wear resistant material is positioned substantially without overlapping the threaded interval.

29. The casing connection of claim 24 wherein the wear resistant material is applied by hard facing.

30. The casing connection of claim 24 wherein the wear resistant material is formed by heat treatment.

31. A casing connection comprising: a casing joint including a tubular body and a pin end extending from the tubular body, the pin end including threads formed thereon; and a casing coupling including a box end, the box end including an end edge and a threaded interval therein, and an extension between the end edge and the threaded interval, the extension including a wear resistant material on an outer surface of the extension, the wear resistant material having a wear resistance greater than the threaded interval, the casing coupling threadedly engaged by load bearing threads of the threaded interval to the threads of the pin end with the extension extending out over the tubular body of the casing joint.

32. The casing connection of claim 31 wherein the end edge defines a leading edge of the casing coupling during insertion of a casing string including the connection into a well.

33. The casing connection of claim 31 wherein the box end is on a mill end.

34. The casing connection of claim 31 wherein the extension has a non-threaded inner surface.

35. The casing connection of claim 31 wherein the wear resistant material is positioned substantially without overlapping the threaded interval.

36. The casing connection of claim 31 wherein the wear resistant material is applied by hard facing.

37. The casing connection of claim 31 wherein the wear resistant material is formed by heat treatment.

* * * * *